US006790006B2

(12) United States Patent
Robb

(10) Patent No.: US 6,790,006 B2
(45) Date of Patent: Sep. 14, 2004

(54) FLEXIBLE METAL ELEMENT FAN ISOLATION MOUNT

(75) Inventor: Neil E. Robb, Jackson, MI (US)

(73) Assignee: BorgWarner, Inc., Auburn Hills, MI (US)

( * ) Notice: Subject to any disclaimer, the term of this patent is extended or adjusted under 35 U.S.C. 154(b) by 57 days.

(21) Appl. No.: 10/179,654

(22) Filed: Jun. 25, 2002

(65) Prior Publication Data

US 2003/0235500 A1 Dec. 25, 2003

(51) Int. Cl.[7] ..... F04D 29/20
(52) U.S. Cl. ..... 416/135; 416/169 A; 416/500
(58) Field of Search ..... 416/133, 169 H, 416/204 R, 244, 500

(56) References Cited

U.S. PATENT DOCUMENTS 3,353,373 A 11/1967 Schumacher et al.
3,985,000 A 10/1976 Hartz
4,317,339 A 3/1982 Schmidt
4,487,551 A 12/1984 Mizutani et al.
5,219,314 A 6/1993 Her et al.
5,271,717 A * 12/1993 Sato ..... 416/204 R
5,295,912 A 3/1994 Müller et al.
5,297,936 A 3/1994 Sato
5,387,157 A 2/1995 Nameny
5,655,882 A 8/1997 Morgan et al.

* cited by examiner

*Primary Examiner*—Edward K. Look
*Assistant Examiner*—Dwayne White
(74) *Attorney, Agent, or Firm*—Greg Dziegielewski; Artz & Artz, P.C.

(57) ABSTRACT

A flexible metal disk used to mount the fan to the fan drive. The metal disk is a resilient mounting, and as such reduces vibration levels between the fan and fan drive, thereby preventing damage to various components within the cooling system. The flexible metal disk also functions to self align the fan and the fan drive. The flexible metal disk is also durable, and therefore offers improved creep and deterioration resistance as compared with typical elastomeric mountings. In another preferred embodiment, multiple flexible metal disks may be coupled together and used to mount the fan to the fan drive to provide additional damping as compared with single disk systems.

12 Claims, 3 Drawing Sheets

FLEXIBLE METAL ELEMENT FAN ISOLATION MOUNT

TECHNICAL FIELD

The invention relates generally to cooling systems and more specifically to a flexible metal element fan isolation mount.

BACKGROUND ART

Cooling systems are used on vehicles today to provide cooling to an engine during operation. A typical cooling system comprises a combination water pump and fan drive. Fan drives are typically driven by the engine crankshaft at a fixed ratio to cool engine coolant as it flows through a radiator. More specifically, a fan that is rigidly mounted to the fan drive generates the airflow as a function of engine crankshaft rotational speed for cooling the radiator.

One problem that is common in these types of cooling systems is vibration caused by the mounting of the fan to the fan drive. This vibration can be detrimental to various components in the cooling system, including the fan hub or water pump.

It has been shown that if the fan is resiliently mounted to the fan drive (for example, using rubber grommets under the bolt heads and between the fan and fan drive), substantial reduction in cooling system vibration levels can be achieved. However, rubber or other elastomeric mounts can change properties over time with temperature, thereby affecting vibration levels. Further, elastomeric materials are also subject to creep and deterioration over time.

It is thus highly desirable to introduce a flexible, durable mounting apparatus to mount the fan to the fan drive to decrease vibration levels.

SUMMARY OF THE INVENTION

The above and other objects of the invention are met by the present invention that is an improvement over known cooling systems.

The present invention includes the use of a flexible metal disk, or elements, to mount the fan to the fan drive. The metal disk is a resilient mounting, and as such reduces vibration levels between the fan and fan drive, thereby preventing damage to various components within the cooling system. The flexible metal disk also functions to self align the fan and the fan drive. The flexible metal disk is also durable, and therefore offers improved creep and deterioration resistance as compared with typical elastomeric mountings.

In another preferred embodiment, multiple flexible metal disks may be coupled together to provide additional damping as compared with single disk systems.

Other features, benefits and advantages of the present invention will become apparent from the following description of the invention, when viewed in accordance with the attached drawings and appended claims.

BEST MODE(S) FOR CARRYING OUT THE INVENTION

Figure 1:
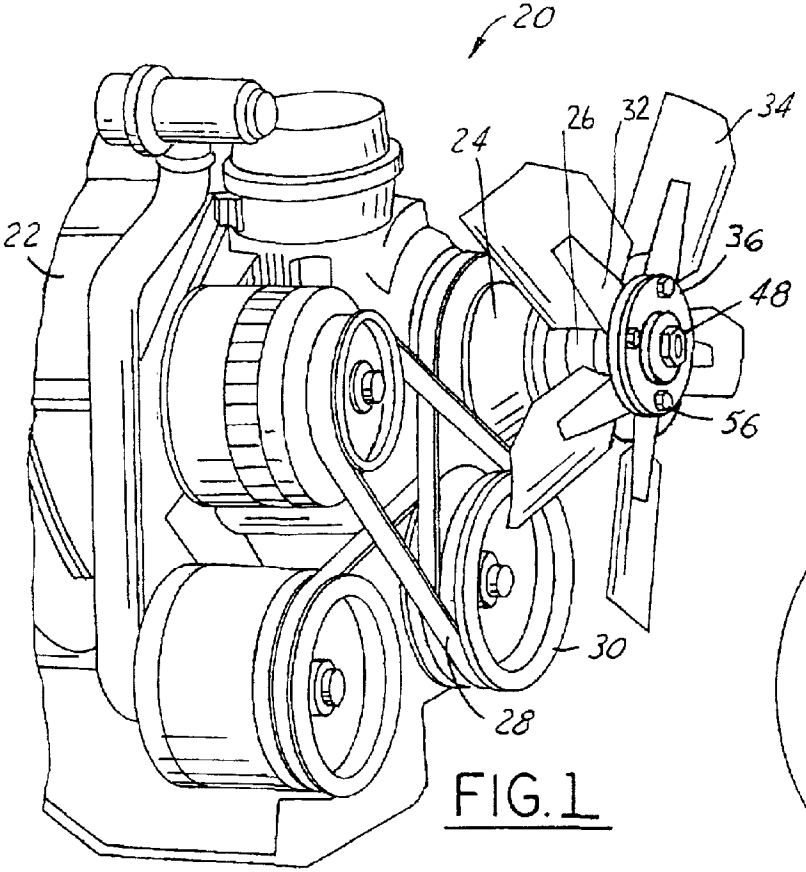
FIG. 1 is a perspective view of a combination fan drive and water pump according to one preferred embodiment of the present invention.

Referring now to FIG. 1, a cooling system 20 for an engine 22 is shown as having a coupled water pump 24 and fan drive 26. A fan 32 having a series of fan blades 34 is rigidly mounted to the fan drive 26. A series of belts 28 convert torque from an engine crankshaft 30 to drive the water pump 24 and fan drive 26 in a manner well known in the art. As the fan drive 26 rotates, the blades 34 of the coupled fan 32 provide cooling airflow to a radiator (not shown) of the engine 22.

Figure 5:
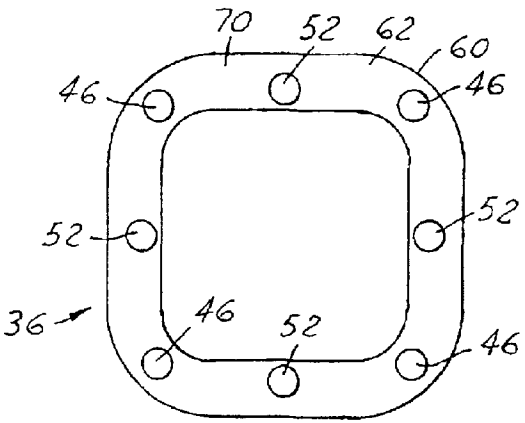
FIG. 5 is a front view of a flexible metal element used to mount the fan to the fan drive as shown in FIGS. 2–4.
Figure 6:
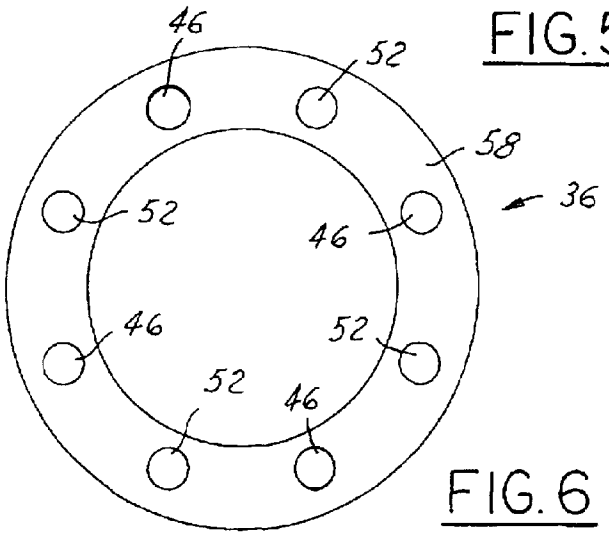
FIG. 6 is a front view of a flexible metal element used to mount the fan to the fan drive according to another preferred embodiment of the present invention.
Figure 3:
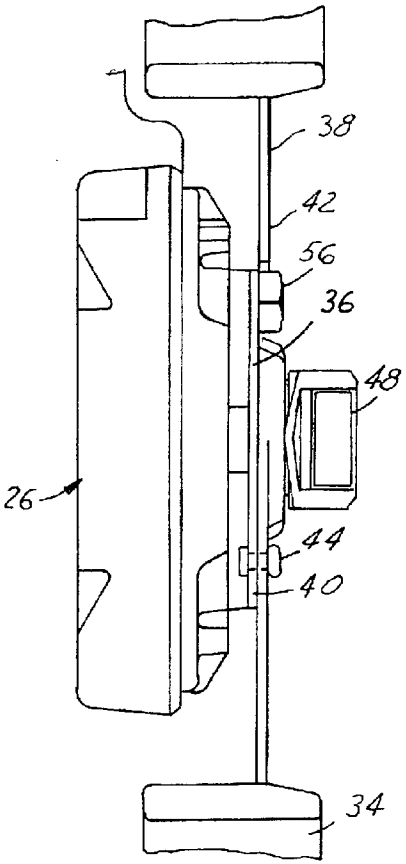
FIG. 3 is a partial side view of FIG. 2.
Figure 2:
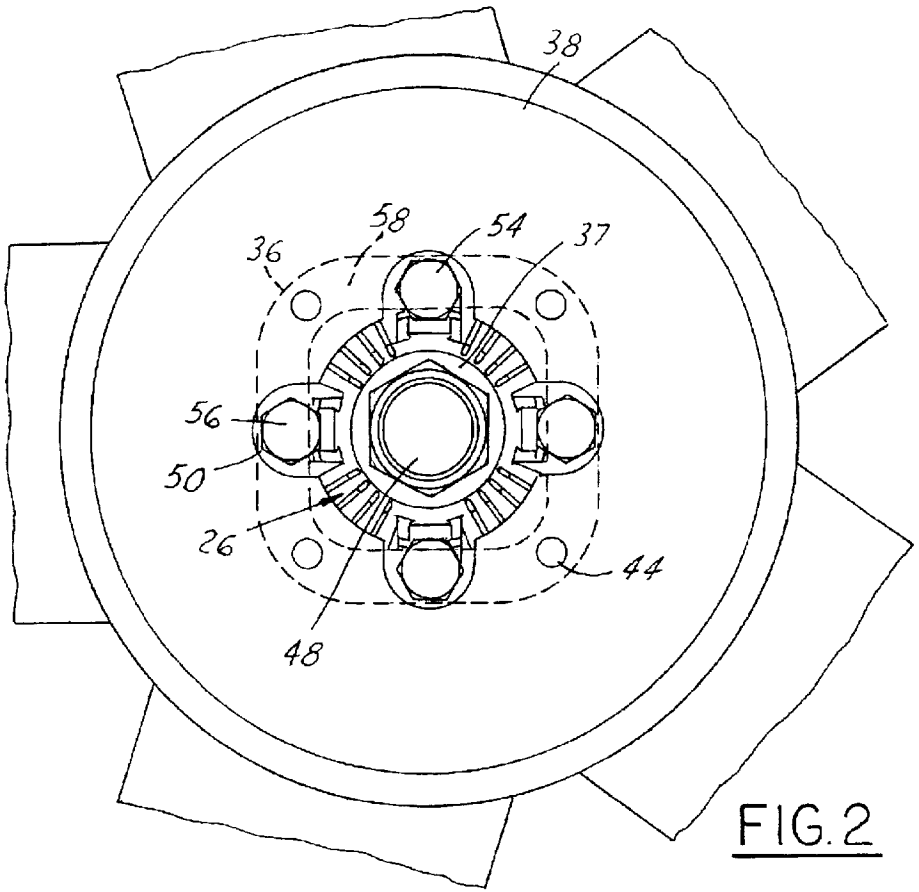
FIG. 2 is a rear view of the fan drive of FIG. 1.

As best seen in FIGS. 2 and 3, a flexible metal disk 36 is used to mount the hub 38 of the fan 32 to the fan drive 26. To accomplish this, a back side 40 of the disk 36 is closely coupled to a corresponding flat side region 42 on the hub 38. A plurality of rivets 44 are inserted through a corresponding rivet hole 46 (as shown in FIGS. 5 and 6) extending through the disk 36 and riveted to the flat side region 42 to secure the disk 36 to the hub 38. Of course, as is appreciated by a person skilled in the art, other types of mounting devices other than rivets 44 may be used to secure the flexible disk 36 to the hub 38.

An outer end 48 of the fan drive 26 is then inserted through a hollow center region 37 of the hub 38 and reversibly coupled to the fan drive 26 using the flexible metal disk 36. This is accomplished by inserting a bolt 50 through each of a plurality of bolt holes 52 on the disk 36 and securing them within a corresponding mounting hole 54. When properly mounted, the head 56 of each bolt 50 is closely coupled to the front side 58 of the disk 36 opposite the mounting holes 54. Of course, as is well known in the art, other types of coupling devices other than bolts 50 secured within a corresponding mounting hole 54 may be used.

The disk 36 retains torsional rigidity while allowing angular misalignment between the fan 32 and fan drive 26. This prevents the fan 32 from transmitting vibration to the fan drive 26 or vice versa to damage cooling system components such as the water pump 24 or hub 38. The disk 36 also prevents the fan 32 and fan drive 26 from cooperating at a resonant condition.

Figure 4:
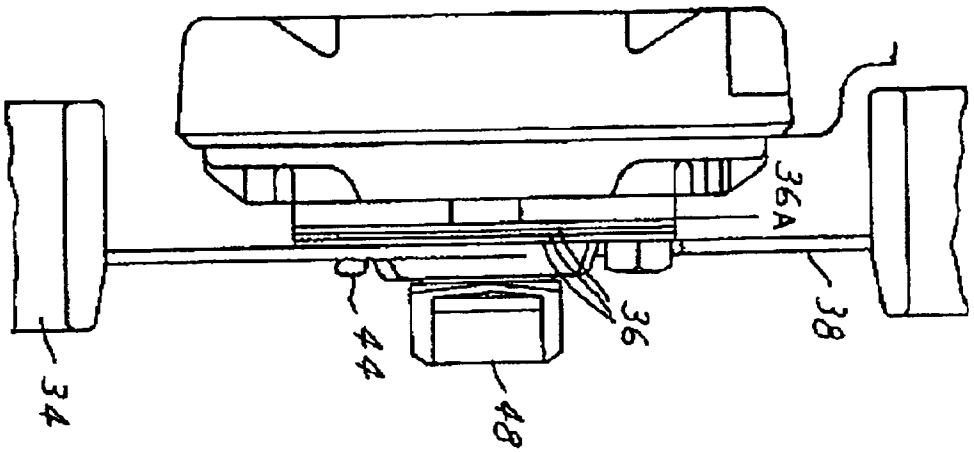
FIG. 4 is a side view of FIG. 2 having multiple flexible metal elements.

As seen in FIG. 4, multiple disks 36 can be laminated together or otherwise coupled such that the back side 40 of one disk 36 is closely coupled to the front side 58 of the next respective disk 36 and such that the corresponding bolt holes 52 and rivet holes 46 match up to form a multiple disk layer 36A. These multiple disk layers 36A may then used to mount the fan 32 to the fan drive 26 in a manner similar to that described above with respect to FIG. 3. As the number of disks 36 in the disk layer 36A increases, the amount of damping achieved between the fan 32 and fan drive 26 correspondingly increases. Preferably, approximately 1–4 disks 36 are used in the disk layer 36A for optimal damping characteristics and cost savings.

FIGS. 3 and 4, as illustrated, are not intended to represent a completely accurate side view of FIG. 2 having one or multiple disks 36, 36A, instead these Figures are drawn to more clearly illustrate how the rivets 44 and bolts 50 are used to couple the disks 36, 36A to the fan 32 and fan drive 26.

FIGS. 5 and 6 illustrate a plan view of the front side 58 of the flexible disk 36 according to two possible preferred embodiments. The embodiment according to FIG. 5, as shown above in FIGS. 2–4, is substantially square shaped and continuous (i.e. not segmented), while the embodiment in FIG. 6 is substantially circular shaped and continuous. The disk 36 preferably comprises a flexible material that has sufficient strength and flexibility at all possible engine operating conditions. The material must resist deterioration and creep throughout the life of the engine 22. Flexible disks 36 made from metals such as aluminum or steel are preferred for these reasons.

As shown in FIG. 5, each of the plurality of rivet holes 46 and bolt holes 52 are located symmetrically about the disk 36 such that each rivet hole 46 is located at a corner region 60 of the square shaped front side 58 and such that each bolt hole is located equally between each rivet hole 46 on a side region 62 of the front side 58. As is understood by persons of skill in the art, during operation of the engine 22 to drive the fan drive 26 and water pump 24, any flexing that takes place in the disk 36 will occur along each side region 62 between each rivet hole 46 and bolt holt 52 and will therefore not be transmitted as vibration through the cooling system 20.

Of course, in alternative embodiments, the positioning of the rivet holes 46 and bolt holes 52 could be switched and still fall within the spirit of the present invention. Further, the number of rivet holes 46 and/or bolt holes 52 could be increased or decreased and still fall within the spirit of the present invention.

In addition, the shape of the disk 36 could be altered in a wide variety of different manners and still fall within the spirit of the present invention. This is illustrated in FIG. 6, in which the disk 36 is substantially circular in shape and comprises a series of rivet holes 46 and bolt holes spaced circumferentially around the disk 36.

As shown in FIG. 6, these holes 46, 52 are evenly spaced and alternating around the circumference of the disk 36. However, it should be appreciated by those of skill in the art that the holes 46, 52 may be placed in a non-alternating fashion or that the spacing between each respective rivet hole 46 and bolt hole 52 may vary in a symmetrical manner around the circumference of the disk and still fall within the spirit of the present invention. As is understood by persons of skill in the art, during operation of the engine 22 to drive the fan drive 26 and water pump 24, any flexing that takes place in the disk 36 will occur between each rivet hole 46 and bolt holt 52 and will therefore not be transmitted as vibration through the cooling system 20.

In the preferred embodiments of FIGS. 5 and 6, the flexible metal disk 36 offers many improvements to other types of mounts that have been used in cooling systems 20. First, the metallic disk 36 retains torsional rigidity but allows angular misalignment of the fan 32 and fan drive 26, thus preventing the fan 32 from transmitting vibration through the fan drive 26 and also preventing the fan drive 26 from transmitting vibration to the fan 32. The disk 36 also prevents the fan 32 and fan drive 26 from cooperating in resonant condition, a condition that is potentially detrimental to components of the cooling system 20, including but not limited to the fan hub 38 and the water pump 24. Further, because the disk 36 is made of flexible metal, it resists deterioration and creep over time as compared with elastomeric mounts. Also, the strength and flexible mechanical properties of the flexible metal disk 36 remain relatively constant throughout the variation engine operating temperatures as compared with elastomeric mounts, and as such system reaction to various engine operating temperatures can be more closely controlled.

While the best modes for carrying out the present invention have been described in detail herein, those familiar with the art to which this invention relates will recognize various alternate designs and embodiments for practicing the invention as defined by the following claims. All of these embodiments and variations that come within the scope and meaning of the present claims are included within the scope of the present invention. For example, the same technique is also used to make flexible disk shaft couplings.

What is claimed is:

1. A method for improving damping characteristics between a fan and a fan drive a cooling system comprising:

forming at least two flexible metal disks, wherein each of said at least two flexible metal disks has a plurality of bolt holes and a plurality of rivet holes;

coupling a front side of one of said at least two flexible metal disks to a back side of the next respective one of said at least two flexible disks to form a multiple disk layer, said formed multiple disk layer having a first outer side and a second outer side;

coupling said first outer side of said multiple disk layer to the fan; and coupling said second outer side of said multiple disk layer to the fan drive.

2. The method of claim 1, wherein coupling said first outer side comprises:

closely coupling a first outer side of said multiple disk layer to a flat side region of a hub of the fan;

inserting a rivet through each of a respective one of a plurality of rivet holes on each of said at least to flexible metal disks; and securing said rivet to said flat side region.

3. The method of claim 1, wherein coupling said second outer side comprises:

closely coupling said second outer side of said multiple disk layer to said fan drive;

inserting a bolt within each of a respective one of a plurality of bolt holes of each of said at least two flexible disks of said multiple disk layer such that a head of said bolt is closely coupled said first outer side of said multiple disk layer;

securing said bolt within a corresponding one of a plurality of mounting holes on the fan drive such that said head remains closely coupled to said first outer side.

4. A fan mounting system comprising:

a fan having a hub and a plurality of blades, said hub having a flat side region and a hollow center region;

a fan drive having an outer end, said first end coupled within said hollow center region, said outer end having a plurality of mounting holes; and at least two flexible metal disks for coupling said hub to said fan drive, said at least two flexible metal disk used to decrease vibration between said fan and said fan drive and to self center said fan on said fan drive.

5. The fan mounting system of claim 4, wherein said at least two flexible metal disks are coupled to said hub by inserting a rivet through each respective one of a plurality of rivet holes of each of said at least two flexible metal disks and securing said rivet to said flat side region of said hub.

6. The fan mounting system of claim 5, wherein said at least two flexible metal disks are reversibly coupled to said outer end by:

coupling a back side of an outer one of said at least two flexible disks to said flat side region of said hub;

inserting a bolt having a head within each respective one of a plurality of bolt holes of each of said at least two flexible disks;

reversibly securing said bolt within a corresponding one of said plurality of mounting holes.

7. The fan mounting system of claim 5, wherein said at least two flexible metal disks comprises at least two flexible aluminum disks.

8. The fan mounting system of claim 5, wherein said at least two flexible metal disks comprises at least two flexible steel disks.

9. The fan mounting system of claim 5, wherein said at least two metal disks comprises at least two continuous flexible metal disks.

10. A method for improving damping characteristics between fan and a fan drive in a cooling system comprising:

coupling at least two flexible metal disks to the fan; and coupling said at least two flexible metal disks to the fan drive.

11. The method of claim 10, wherein coupling at least two flexible metal disks to the fan comprises;

inserting a rivet through each respective one of a plurality of rivet holes of each of said at least two flexible metal disks; and securing said rivet to a flat side region of a hub of the fan.

12. The method of claim 11, wherein coupling said at least two flexible metal disk to the fan drive comprises:

inserting a bolt having a head within each respective one of a plurality of bolt holes of each of said at least two flexible disks;

coupling said fan drive to said at least two flexible metal disks by securing said bolt within a corresponding one of a plurality of mounting holes on the fan drive.

* * * * *